US005511281A

United States Patent [19]

Webster

[11] Patent Number: 5,511,281

[45] Date of Patent: Apr. 30, 1996

[54] BLOWER VACUUM

[75] Inventor: Craig D. Webster, Newcastle-upon-Tyne, United Kingdom

[73] Assignee: Black & Decker Inc., Newark, Del.

[21] Appl. No.: 410,391

[22] Filed: Mar. 23, 1995

[30] Foreign Application Priority Data

Mar. 31, 1994 [GB] United Kingdom ..... 9406532.3

[51] Int. Cl.[6] ..... A47L 5/24

[52] U.S. Cl. ..... 15/330; 15/339; 15/344; 15/405; 15/409; 241/55

[58] Field of Search ..... 15/339, 405, 409, 15/330, 344; 241/55

[56] References Cited

U.S. PATENT DOCUMENTS 4,325,163 4/1982 Mattson .
4,663,799 5/1987 Kiyooka ..... 15/330
4,817,230 4/1989 Kiyooka .
4,955,107 9/1990 Kawai ..... 15/330 X
5,245,726 9/1993 Rote et al. .

FOREIGN PATENT DOCUMENTS 0198654 10/1986 European Pat. Off. .
0443882 8/1991 European Pat. Off. .
0587272 3/1994 European Pat. Off. .

*Primary Examiner*—Chris K. Moore
*Attorney, Agent, or Firm*—Charles E. Yocum; Dennis A. Dearing; John D. Del Ponti

[57] ABSTRACT

A debris collecting apparatus (2) includes a debris conduit (4), one end of which debris conduit is an operating end (8) and the other end of which debris conduit (4) is adapted for attachment to a debris collecting container (30); the apparatus further generates an entrained air flow at the operating end (8) of the debris conduit (4) into the debris conduit (4) and comminutes the debris. Also, the entrained air flow is generated external to the debris conduit (4), but the comminution of the debris occurs within the debris conduit (4).

11 Claims, 1 Drawing Sheet

BLOWER VACUUM

Figure 1:
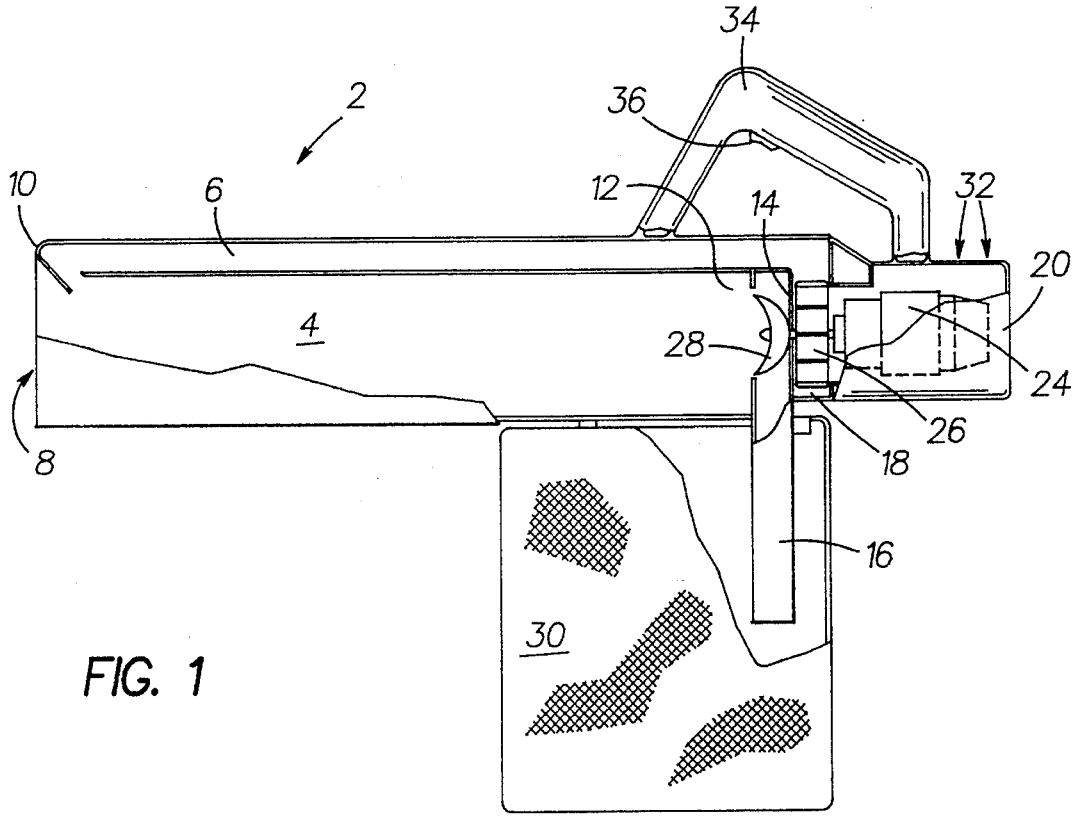

The present invention relates to a debris collecting apparatus, in particular a garden debris collecting apparatus, preferably of the kind which may be used either in a vacuum mode to suck debris into the apparatus or in a blowing mode to discharge a stream of air from a nozzle so that debris can be blown into piles.

Such debris collecting apparatus is already known. In one such apparatus, according to U.S. Pat. No. 4,325,163, a centrifugal impeller is used to take in air through an inlet and blow it through an outlet. In the vacuum mode, debris passes through the impeller, which will inevitably result in wear to the impeller, even though a chopping blade may be mounted on the impeller shaft immediately upstream of the impeller.

It is also known, for example from European Patent No. 114,114, to provide a debris collection apparatus in which an impeller is used to create an entrained air flow. In the vacuum mode, debris is picked up in this entrained air flow and carried via a duct to a collecting bay. The debris does not pass through the impeller, thus reducing wear and tear to the impeller. Such a system, however, does have the disadvantage that there is no comminution, or particle size reduction, of the debris, and this can result in a frequent need to empty the collection bag.

It is an object of the present invention to provide a debris collecting apparatus in which the above disadvantages are reduced or substantially obviated.

The present invention therefore provides a debris collecting apparatus including a debris conduit, one end of which debris conduit is an operating end;

and the other end of which debris conduit is adapted for attachment to a debris collecting container;

means for generating an entrained air flow at the operating end of the debris conduit into the debris conduit and means for comminution of the debris, characterised in that the means for generating the entrained air flow is arranged external to the debris conduit and the means for comminution of the debris is arranged within the debris conduit.

The means for generating the entrained air flow and the means for comminution of the debris are preferably mounted on the same axis.

In a preferred embodiment of the debris collecting apparatus according to the invention, the means for generating the entrained air flow at the operating end of the debris conduit comprises an impeller and means to direct the air flow generated by the impeller from the operating end into the debris conduit.

In a further preferred embodiment of the debris collecting apparatus according to the invention, the means for comminution of the debris may comprise a second impeller or one or more shredding blades mounted for rotation in the debris conduit.

A second impeller may also be mounted in the debris conduit to assist air flow, and this impeller is preferably mounted on the same axis as the blades.

In an alternative design of shredder, the blades of the shredder are in the form of impeller blades and serve both to shred the debris and operate as an impeller.

It is particularly preferred that the means for generating an air flow at the operating end of the debris conduit and the debris comminution means should be driven by a single motor.

In a particularly preferred embodiment of the debris collection apparatus according to the invention, a switch arrangement is provided which is operable to switch between a first collecting mode in which the debris passes through the debris comminution means, and a second collecting mode in which it passes directly into a debris collecting container.

The switch arrangement preferably comprises a pivoted closure means pivotable between a first position in which debris is passed through the debris comminution means and a second position in which the debris passes directly into a debris collection container.

In both positions, the pivoted closure means acts as a guard for the debris comminution means.

The first collecting mode is suitably selected by the operator when collecting, for example, garden debris, the bulk of which can be substantially reduced by comminution, and the second collecting mode is suitably selected when collecting debris which does not require comminution.

Figure 2:
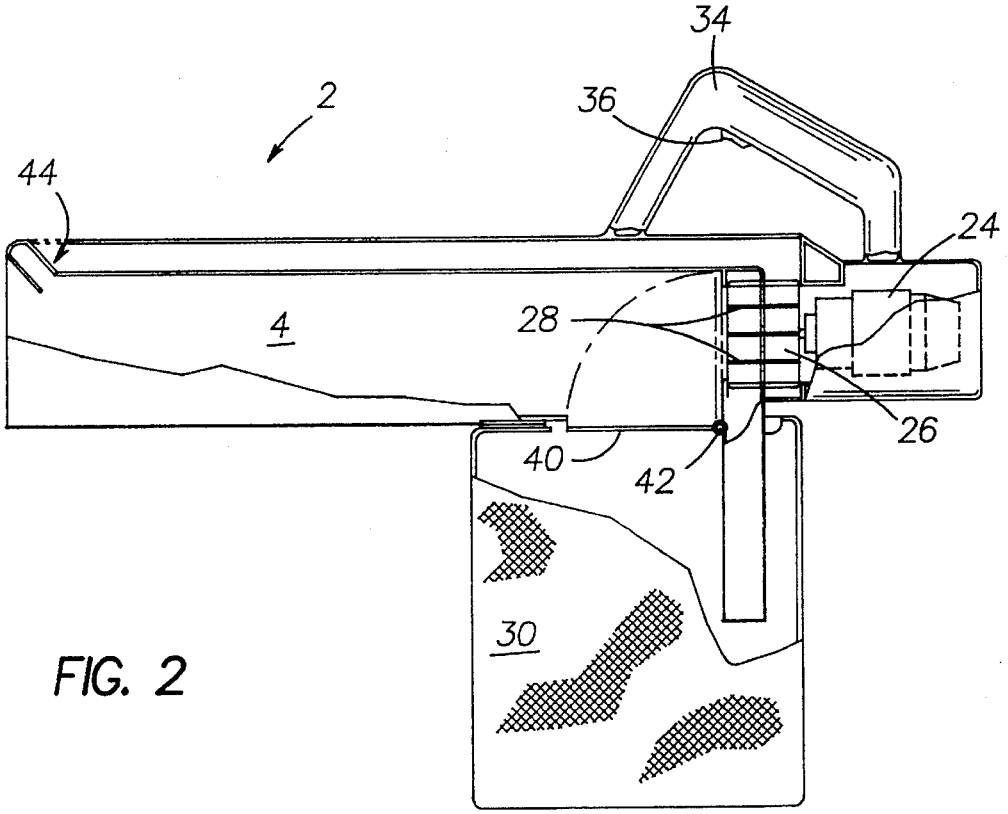

The invention will now be further described with reference to the accompanying drawings in which;

FIG. 1 is a side view, partially broken away of a first embodiment of a debris collecting apparatus according to the invention and FIG. 2 is a side view, partially broken away, of a second embodiment of a debris collecting apparatus according to the invention.

As can be seen from FIG. 1, a debris collection apparatus shown generally at (2) comprises a debris conduit (4), and a duct (6) extending parallel to the debris conduit (4). The debris conduit (4) has an operating end (8) and the duct (6) is open at the end where it is adjacent to the operating end (8) and terminates in curved surface (10). The end (12) of the debris conduit (4) remote from the operating end (8) comprises an end wall (14). A discharge duct (16) is open to the debris conduit (4) and projects from a side wall of that conduit adjacent to the end wall (14) thereof. The duct (6) terminates at its end adjacent to the end wall (14) in a chamber (18) which extends across the combined area of the duct (6) and debris conduit (4). A motor housing (20) is mounted on the outer wall (22) of the chamber (18). A motor (24) is mounted in the motor housing (20) and an output shaft (not shown) of the motor (24) projects through an aperture (not shown) in the outer wall (22) and an aperture (not shown) provided in the end wall (14). An impeller (26) is mounted in the output shaft of the motor in the chamber (18) and a set of shredding blades (28) is mounted on the output shaft in the debris conduit (4) adjacent to the end wall (14).

A bag (30) is attached to the apparatus (2) so that the discharge duct (16) opens into the bag (30). The bag (30) can be removed for emptying.

Air input holes (32) are provided in the motor housing (20) and in the outer wall (22), communicating between the motor housing (20) and the chamber (18).

A handle (34) with switch means (36) is mounted between the housing (20) and the debris collection apparatus (2), the switch means (36) being operable to control the supply of electrical power to the motor (24).

In operation, as the motor (24) is switched on, the impeller (26) and shredding blades (28) rotate rapidly. An air flow is generated by the impeller (26) along the duct (6) to the curved surface (10) at its end. As the air flow hits this curved surface (10) it is directed into the debris conduit (4). If the operating end of the debris conduit (4) is directed towards debris, the debris is lifted by the air stream and directed towards the blades (28), where it is comminuted, and then taken through the discharge duct (16) into the collection bag (30).

In an alternative embodiment shown in FIG. 2, a closure means (40) is pivoted at (42) between a first position (shown in solid lines) in which the debris collection apparatus (2) operates as described for the embodiment of FIG. 1, and a second position (shown in dotted lines) in which the shredder blades (28) are isolated from the debris conduit and the debris is collected directly in the collection bag (30).

Where the debris collection apparatus (2) is operating with the closure means (40) in the first position, the shredder blades (28) function in three ways; to shred debris, to transport shredded material to the collection bag (30) and to assist the entrained air flow.

The closure means (40) serves not only selectively to isolate the shredder blades (28) from the debris conduit, but also as a guard, to restrict access to the shredder blades when the collection bag (30) is removed.

The end of the duct (6) remote from the impeller (26) is provided with a switch means (44) by which the air flow can be selectively directed either to create a vacuum flow or as a blower. The switch means (44) comprises a flap (46) pivoted at A between a first position (shown in solid lines in FIG. 2) in which the airflow generated by the impeller (26) is directed away from the debris conduit (4) and the apparatus functions as a blower. When the flap (46) is pivoted into the second position (shown in dotted lines in FIG. 2) the air flow generated by the impeller (26) is directed into the debris conduit, and the apparatus operates as described for the first embodiment.

I claim:

1. A debris collecting apparatus including a debris conduit, one end of which debris conduit is an operating end and the other end of which debris conduit is adapted for attachment to a debris collecting container;

means for generating an entrained air flow at the operating end of the debris conduit into the debris conduit and means for comminution of the debris, characterised in that the means for generating the entrained air flow is arranged external to the debris conduit and the means for comminution of the debris is arranged within the debris conduit.

2. A debris collecting apparatus according to claim 1 characterised in that the means for generating the entrained air flow and the means for comminution of the debris are mounted on the same axis.

3. A debris collecting apparatus according to claim 1, characterised in that the means for generating the entrained air flow at the operating end of the debris conduit comprises an impeller and means to direct the air flow generated by the impeller from the operating end into the debris conduit.

4. A debris collecting apparatus according to claim 3, characterised in that the means for comminution of the debris comprises a second impeller mounted for rotation in the debris conduit.

5. A debris collecting apparatus according claim 3, characterised in that the means for comminution of the debris comprises at least one shredding blade, mounted for rotation in the debris conduit.

6. A debris collecting apparatus according to claim 5 characterised in that the impeller is mounted on the same axis as the shredding blades.

7. A debris collecting apparatus according to claim 1, characterised in that the means for generating an air flow at the operating end of the debris conduit and the means for comminution of the debris are driven by a single motor.

8. A debris collecting apparatus according to claim 1, characterised in that the means for generating an air flow at the operating end of the debris conduit and the means for comminution of the debris are separated by an end wall of the debris conduit.

9. A debris collecting apparatus according to claim 1, characterised in that it further comprises a switch arrangement operable to switch between a first collecting mode in which the debris passes through the debris comminution means, and a second collecting mode in which it passes directly into a debris collecting container.

10. A debris collecting apparatus according to claim 9 characterised in that the switch arrangement comprises a pivoted closure means pivotable between a first position in which debris is passed through the debris comminution means and a second position in which the debris passes directly into a debris collection container.

11. A debris collecting apparatus according to claim 1, characterised in that a switching arrangement is provided so that it can be switched between a vacuum mode and a blowing mode.

* * * * *